United States Patent [19]

Pickel

[11] 4,127,776

[45] Nov. 28, 1978

[54] X-RAY GENERATOR SELF CENTERING TUBE SHIELD

[75] Inventor: Richard A. Pickel, Toms River, N.J.

[73] Assignee: Pennwalt Corporation, Philadelphia, Pa.

[21] Appl. No.: 828,695

[22] Filed: Aug. 29, 1977

[51] Int. Cl.[2] ..... H01J 35/16

[52] U.S. Cl. ..... 250/520; 250/523

[58] Field of Search ..... 250/520, 522, 523, 524, 250/525

[56] References Cited

U.S. PATENT DOCUMENTS

| | | | |
|---|---|---|---|
| 2,611,095 | 9/1952 | Goldfield | 250/523 |
| 2,925,499 | 2/1960 | Seedel | 250/523 |
| 3,473,028 | 10/1969 | Curry | 250/523 |

*Primary Examiner*—Craig E. Church

[57] ABSTRACT

A conventional X-ray tube and shield assembly for use in dental radiography is modified. The conventional assembly has the X-ray tube affixed within an open-ended cylindrical shield such that the focal point of the tube is centered with respect to a small opening provided in the shield. Positioning of this tube-shield assembly within an X-ray generator is then accomplished by trial and error means. The improvement includes an interiorly threaded tubular member extending outwardly from the shield and concentrically around the small opening of the shield. The threaded tubular member is received by a filter element which is disposed within an eyeport opening of an X-ray generator. Since a close dimensional clearance is provided between the tubular member and eyeport opening, the tubular member thus automatically self-centers the X-ray tube and shield within the X-ray generator upon the filter element threadedly engaging the tubular member.

9 Claims, 5 Drawing Figures

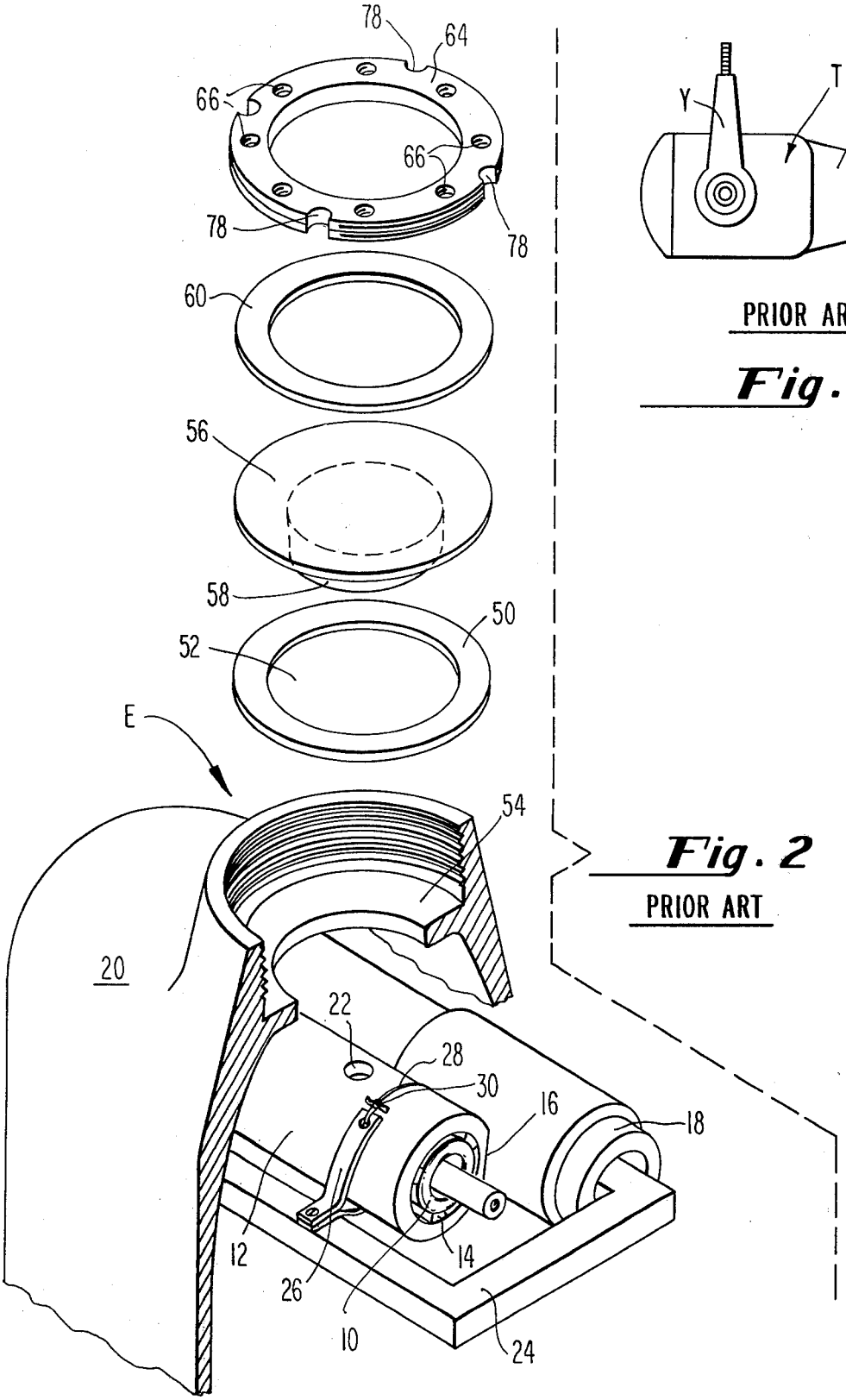
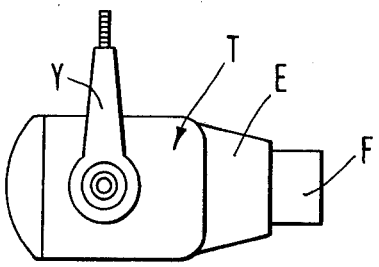
PRIOR ART
Fig. 1
Fig. 2
PRIOR ART

X-RAY GENERATOR SELF CENTERING TUBE SHIELD

STATEMENT OF THE INVENTION

This invention relates to dental X-ray equipment and more particularly concerns an X-ray tube and shield assembly which is automatically self-centering in an X-ray tubehead tank or generator.

BACKGROUND OF THE INVENTION

In the production of X-rays for use in dental radiography, a stream of electrons is generated at a cathode by heating a tungsten filament. A stream of these electrons is caused to impinge at high velocity upon a tungsten anode from which is deflected a stream of X-rays. The movement of the electron stream at high velocity requires (1) the maintenance of the electron path under high vacuum and (2) the maintenance of high voltage differences between the cathode and anode. The housing for the X-ray generator must therefore be sealed and be well insulated from the high voltages. Usually the X-ray tube is supported in a sealed tank and surrounded with oil having a high dielectric constant.

The X-rays are focused on the patient's dental arch. In order to prevent escape of X-rays, the tube is secured within an X-ray opaque shield and the rays permitted to pass through a small opening provided in the shield. Centering this tube-shield and sealing the X-ray generator is critical if the X-rays are to be properly focused. Prior to the present invention, the centering operation has been accomplished by trial and error means and is time-consuming.

BRIEF DESCRIPTION OF THE DRAWINGS

FIG. 1 is an assembly view of a standard X-ray tubehead.

FIG. 2 is a perspective view of a portion of the X-ray tubehead shown in FIG. 1 including an exploded view of elements received in the eyeport opening of the tubehead tank.

DETAILED DESCRIPTION OF THE PRIOR ART

Figure 3:
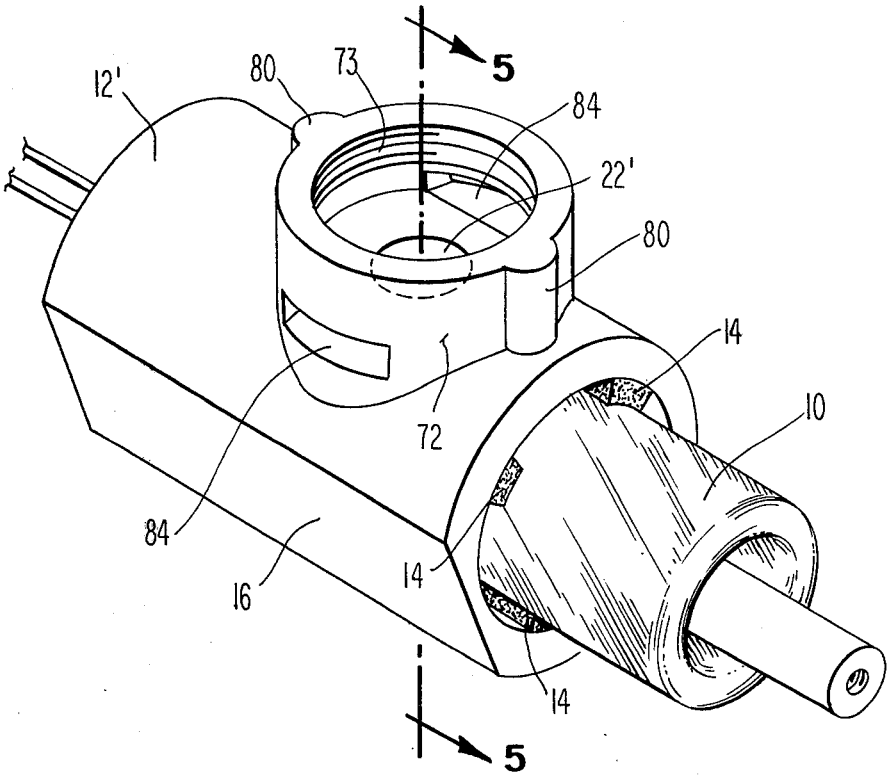
FIG. 3 is a perspective view of a self-centering shield constructed and arranged according to the present invention including an X-ray tube centered therewithin.

Referring now to FIG. 1, a conventional dental X-ray unit is shown wherein an X-ray tubehead T, or X-ray source, is pivotally mounted in a yoke Y. The tubehead is provided with an eyeport E, through which X-rays pass which are then focused by means of the collimating cone F.

In FIG. 2, tube 10, centered within shield 12 by spaced wedges 14, forms a tube-shield assembly. Shield 12 is provided with a flat side 16 to fit against filament transformer coil 18 within tubehead tank 20. Hole 22 in shield 12 is positioned in concentric relationship to the focal point of tube 10. Hole 22 permits passage of the X-rays through eyeport E. Hole 22 also serves as one of the oil filling ports for tank 20.

Centering, or properly positioning the tube-shield assembly with respect to eyeport E requires two separate tests.

(1) Static test: The tube-shield assembly is mounted on filament transformer core 24 by means of semi-circular cradles 26 and tapes 28 which terminate in knots 30. By visual and mechanical means, the tube-shield assembly is manually adjusted while being restrained in the cradle-tape arrangement until hole 22 is aligned with eyeport E. The tube-shield assembly is then cemented into place.

(2) Dynamic test: X-ray tube 10 is electrically connected to filament transformer and high voltage transformer (not shown) located within tank 20. The assembly is then placed in a vacuum chamber for a period of several hours and transformer oil introduced into tank 20 through eyeport E. Removal of air bubbles from the oil is necessary since a potential difference as high as 90,000 volts will exist between the anode and cathode of the tube 10, or about 45,000 volts between either element and the tank casing. Any air bubbles entrapped within the high dielectric transformer oil could promote tracking or arcing between the anode and tank casing.

The tank is now removed from the vacuum chamber and made ready for the dynamic alignment of X-rays. Thus, electric power is supplied to the transformers, and X-rays generated by tube 10 directed onto a calibrated alignment screen located in a lead-lined test booth. Any off-centering of the tube-shield usually requires the oil in tank 20 to be drained, the cemented seals to be broken, the X-ray tube to be re-adjusted and re-cemented, the assembly again cycled in the vacuum chamber and the static tests abovementioned to be performed again.

After the tests have proven satisfactory, a gasket 50, having a central opening 52 is placed on a rim 54 provided by eyeport E. Gasket 50 provides a seal against leakage of the transformer oil. An aluminum alloy filter element 56, which serves to filter soft rays in the main X-ray beam, rests on gasket 50. Filter 56 is provided with a central downwardly extending hollow plug 58 which extends through opening 52 and the eyeport. A metallic washer 60 rests on filter 56, presenting a hard bearing surface for eye nut 64, which is threaded into the eyeport opening and bottomed against washer 60 by means of a plurality of spaced lock screws 66 disposed adjacent to the periphery of the eye nut. Eye nut 64 is provided with a plurality of spaced openings 78 disposed around its periphery to permit oil above washer 60 and filter 56 a means for egress when tightening eye nut 64.

DETAILED DESCRIPTION OF THE INVENTION

Figure 5:
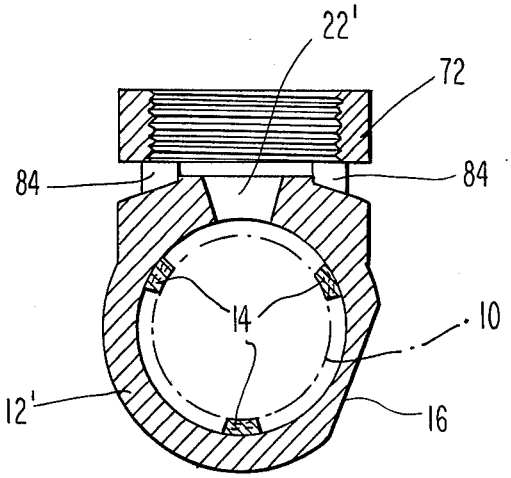
FIG. 5 is a transverse sectional view of the shield of FIG. 3 taken along line 5—5 thereof.
Figure 4:
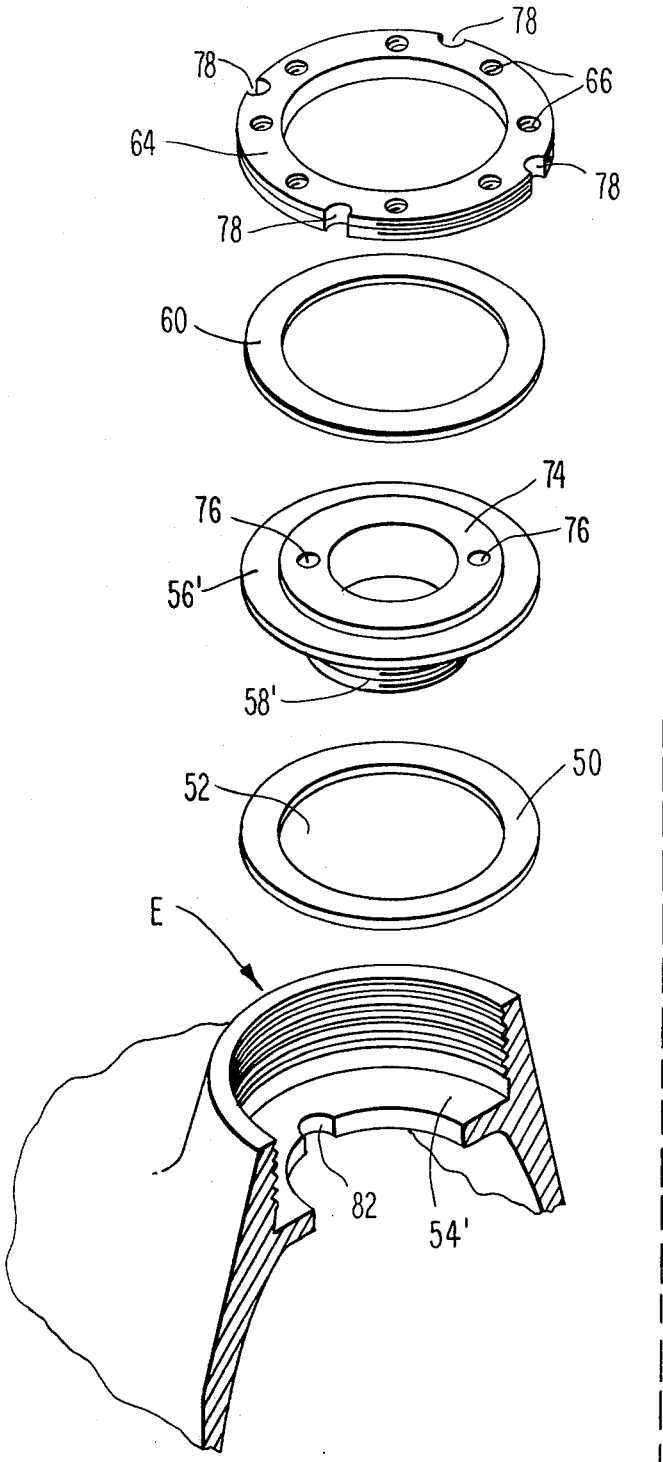
FIG. 4 is a view similar to FIG. 2, but with the eyeport opening and filter element modified in accordance with the invention.

Referring now to FIGS. 3, 4 and 5 of the drawings in which similar reference characters refer to similar parts, the improvement of the present invention comprises modifying shield 12 by providing an upstanding tubular member 72 concentrically about hole 22' of shield 12'. Tubular member 72 is provided with internal threads 73. Hollow plug 58 of filter 56 is exteriorly threaded at 58' to engage threads 73 of tubular member 72. Filter 56' is provided with flange 74 having a pair of opposed spanner holes 76 disposed therein. Flange 74 and spanner holes 76 facilitate the threading of plug 58' into tubular member 72 of shield 12'. Washer 60 rests on filter 56'. Eye nut 64 functions identically as aforedescribed.

The tubular member 72 comprises a pair of oppositely disposed ears or tabs 80 which are received by notches 82 provided in rim 54' of eyeport E. The tabs 80 prevent the rotation of the shield 12' once assembled into tank 20 and thus eliminates the possibility of the anode of tube 10 contacting the tank casing or coming sufficiently close thereto to cause arcing or tracking therebetween. The improved self-centering shield 12' also includes a pair of opposed slot members or oil ports 84, (FIG. 5) to permit the transformer oil to flow therethrough into the tank. The outward slope of the slot members is a fabrication expedient, as well as the angular configuration of central hole 22', which will conveniently have its sides sloped upwardly and outwardly at about a 14° angle from the vertical.

In assembling the improved tube-shield assembly into tank 20, the screw-mounted base (not shown) of the tank will be removed. Ears 80 of tubular member 72 will be inserted into notches 82 of rim 54'. Tubular member 72 is snugly received within eyeport E by virtue of close dimensional clearances therebetween. Threaded plug 58' of filter 56' will now engage threads 73 of tubular member 72 by means of a spanner tool such that the tube-shield is suspended just below eyeport E. Washer 60 and eye nut 64 complete the assembly.

It is apparent that shield 12' is prevented from rotating within tank 20 due to interlocking between ears 80 and notches 82. Further, plug 58' is sufficiently short in length that, even when fully assembled into tubular member 72, the latter will not protrude below the upper surface of rim 84. Since tubular member 72 is centered with respect to eyeport E because of the close dimensional clearances therebetween, as aforementioned, shield 12' will automatically be properly aligned when plug 58' threadedly engages the tubular member. Since shield 12' is now suspended in the tank, it should be further apparent that any need for the cradle-tape-cement arrangement has been completely obviated.

The self-centering shield may be conveniently fabricated by compression molding techniques, and made from red lead oxide bonded with any suitable phenolic resin. the red lead oxide will have a thickness equivalent in X-ray absorption to about 1 mm. of 99% pure lead. The tank casing must be lined with an additional X-ray opaque material at selected portions thereof to provide for any additional radiation shielding that may be necessary.

I claim:

1. In an X-ray tubehead having means for generating X-rays for use in making radiographs of a patient's dental arch and surrounding areas, said tubehead including a tank and an interiorly threaded eyeport at an upper portion of said tank, an X-ray source within said tank, said source having a focal point area from which X-rays emanate, a filament transformer mounted within said tank, a shield provided with open ends adjustably supported on said transformer and containing said X-ray source, said shield having a hole disposed therein intermediate its open ends and aligned with said X-ray source focal point area to permit X-rays emanating from said focal point area to pass through said hole, the improvement therewith comprising an internally threaded tubular member disposed concentrically about said shield hole and extending outwardly from said shield and into said eyeport, said tubular member and said eyeport providing a close dimensional clearance therebetween, port means formed in said tubular member for permitting passage of a fluid therethrough into said tank, and filter means disposed within said eyeport for supporting and suspending said tubular membered shield in said tank when said filter means engages said internal threads of said tubular member for automatically self-centering said shield with respect to said eyeport.

2. The device in accordance with claim 1 wherein said port means comprises a pair of opposed elongated slots disposed along a transverse axis of said shield.

3. The device in accordance with claim 1 wherein said tubular member includes a pair of opposed ears disposed exteriorly said tubular member, said ears disposed in parallel with the axis of said tubular member and aligned axially with the axis of said shield.

4. The device in accordance with claim 3 further characterized by said eyeport being provided with a rim disposed within a lower portion thereof for supporting said filter means, said rim having a central hole therethrough and a pair of opposed cut-out portions in a peripheral area thereof configured to receive said ears on said tubular member to prevent rotation of said shield.

5. The device in accordance with claim 4 wherein said filter means includes a circular filter element received in said eyeport, said filter element having a downwardly extending plug penetrating said hole in said rim area, said plug being exteriorly threaded for reception by said interiorly threaded tubular member.

6. The device of claim 5 wherein a gasket is interposed between said rim area and filter element.

7. The device of claim 6 further characterized by a metallic washer disposed over the filter element, said filer element having a central flange, said metallic washer and said flange providing a substantially hard flat upper surface.

8. The device in accordance with claim 7 further characterized by an eye nut threaded into said interiorly threaded eyeport for bearing against said metallic washer.

9. The device in accordance with claim 8 wherein said eye nut is provided with a plurality of spaced lock screws disposed inwardly the periphery thereof for applying substantially uniform force against said metallic washer to maintain said filter element snugly within said eyeport and said shield securely to said filter elememt.

* * * * *